United States Patent [19]

Harder, Jr.

[11] 4,186,966

[45] Feb. 5, 1980

[54] METAL SEAT FRAME WITH ADHESIVELY SECURED EXTERIOR PLASTIC PARTS

[75] Inventor: Arthur J. Harder, Jr., Franklin Park, Ill.

[73] Assignee: Coach & Car Equipment Corporation, Elk Grove Village, Ill.

[21] Appl. No.: 903,232

[22] Filed: May 5, 1978

[51] Int. Cl.² ..... A47C 7/02

[52] U.S. Cl. ..... 297/452

[58] Field of Search ..... 297/451, 452, 454–456; 403/265, 405, 406; 85/63, DIG. 2

[56] References Cited

U.S. PATENT DOCUMENTS

| | | | |
|---|---|---|---|
| 305,388 | 9/1884 | Heyde | 403/265 X |
| 3,669,499 | 6/1972 | Semplonios et al. | 297/455 |
| 3,873,155 | 3/1975 | Barbecki | 297/455 X |
| 3,907,363 | 9/1975 | Baker et al. | 297/455 X |

*Primary Examiner*—James C. Mitchell

*Attorney, Agent, or Firm*—Merriam, Marshall & Bicknell

[57] ABSTRACT

A seat having a metal frame covered with decorative, exterior plastic parts mounted on the frame with plastic securing elements extending through openings in the metal frame and adhesively secured to the exterior plastic parts.

8 Claims, 5 Drawing Figures

FIG. 1
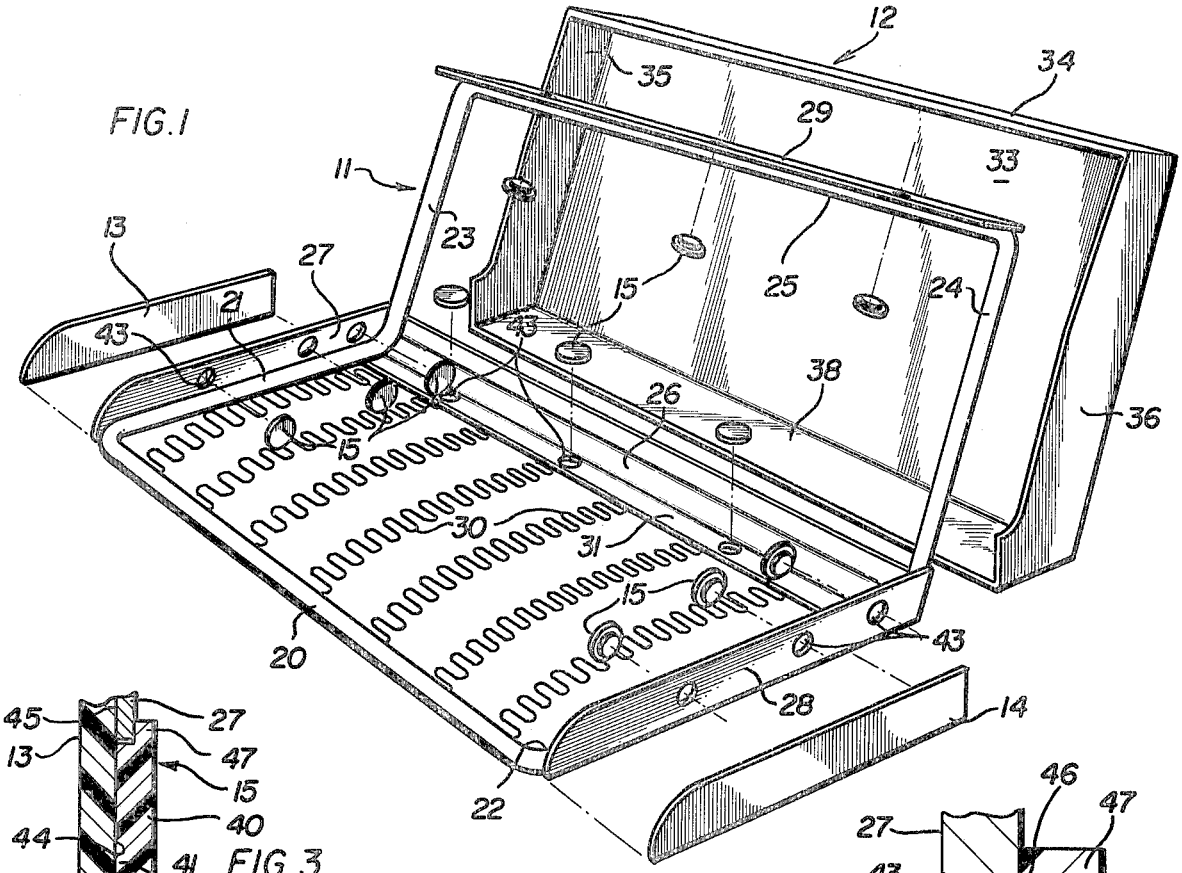
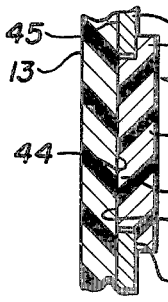
FIG. 3
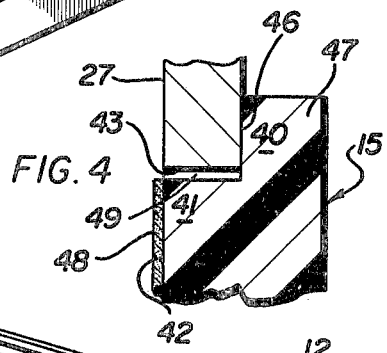
FIG. 4
FIG. 2
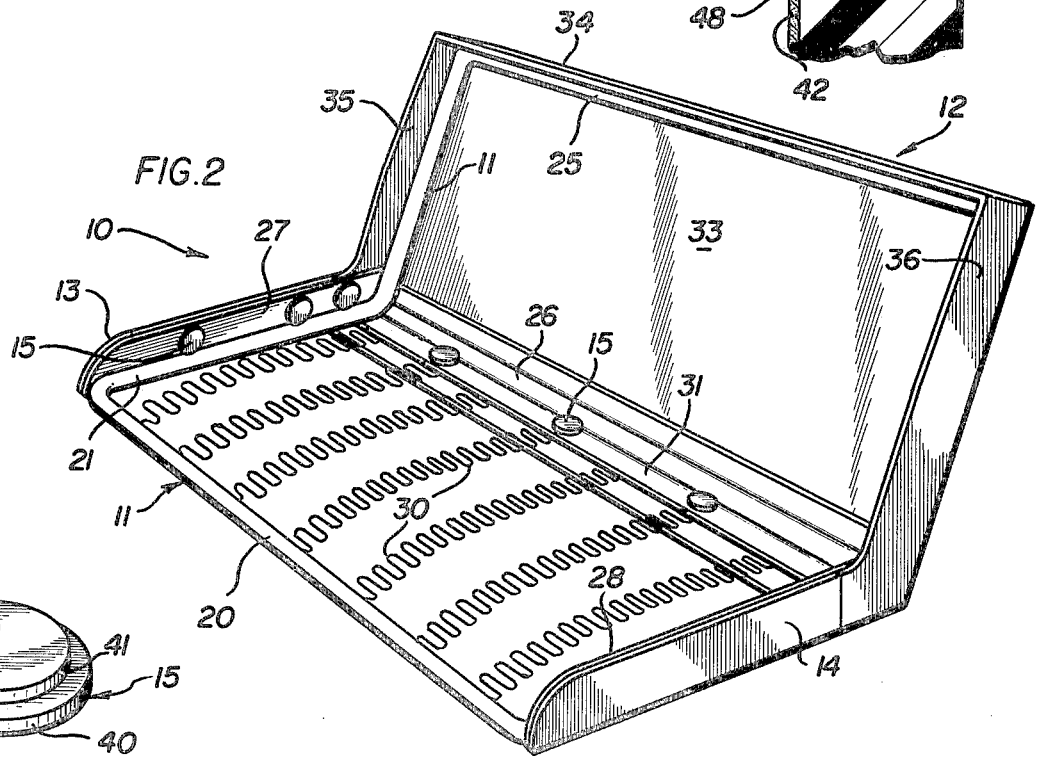
FIG. 5
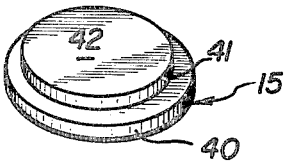

METAL SEAT FRAME WITH ADHESIVELY SECURED EXTERIOR PLASTIC PARTS

BACKGROUND OF THE INVENTION

The present invention relates generally to seats and more particularly to seats for mass transit vehicles such as buses or rapid transit cars.

Conventionally, seats for mass transit vehicles comprise a steel frame on which is mounted a seat cushion and a back cushion. For aesthetic purposes, the exposed portions of the frame, not covered by the seat cushion or back cushion, are covered by an exterior decorative plastic shell at the back and exterior decorative plastic members along the sides.

Certain problems arise in conventional seat constructions utilizing metal seat frames and exterior plastic shells or decorative members. For example, the exterior plastic decorative members and shell are typically assembled to the metal seat frame with metal fasteners. These fasteners can be removed by vandals resulting in the assembly coming apart and rendering the plastic parts readily susceptible to pilferage. In addition, the metal seat frame has a different coefficient of thermal expansion than the plastic of which the exterior decorative members and shell are composed. Accordingly, stresses can develop at the location where the fasteners secure these plastic parts to the metal frame, and this can produce cracks or damage to the exterior plastic parts as the plastic parts and the metal parts undergo different amounts of thermal expansion.

SUMMARY OF THE INVENTION

A seat constructed in accordance with the present invention eliminates the problems described above. The metal fasteners are eliminated entirely. Instead, each exterior plastic part is secured to an adjacent metal frame member with plastic securing elements each having a relatively wide head portion and a relatively narrow shank portion extending from the head portion and terminating at a terminal end. The frame member has an opening therein for receiving the shank portion of the securing element. The head portion of the securing element engages against a surface of the frame member located around the opening in the latter. The shank portion of the securing element extends through the opening and abuts against the inner surface of the adjacent exterior plastic part. The terminal end of the securing element is coated with adhesive for adhesively securing the terminal end of the securing element's shank portion to the inner surface of the adjacent plastic part.

The opening in the metal frame member has a cross-sectional area larger than the cross-sectional area of the shank portion on the securing element extending through the opening. This provides a clearance between the outside of the shank portion and the inside of the opening sufficient to accommodate the differential in thermal expansion between the metal frame member and the exterior plastic part assembled thereto. The securing element is composed of the same plastic material as the exterior plastic shell or decorative members, so that the securing element has the same coefficient of thermal expansion as do the plastic parts.

The securing elements are hidden from view by the exterior plastic shell or decorative members, and are not readily accessible to vandals. The adhesively secured engagement between the securing elements and the inner surface of the exterior plastic parts renders the securing elements incapable of ready removal from the plastic members, even should they become accessible to vandals.

Because of the adhesively secured engagement, involving plastic securing elements in accordance with the present invention, no stresses are developed on the plastic parts in the areas where the plastic parts are assembled to the metal seat frame.

Other features and advantages are inherent in the structure claimed and disclosed or will become apparent to those skilled in the art from the following detailed description in conjunction with the accompanying diagrammatic drawings.

BRIEF DESCRIPTION OF THE DRAWINGS

FIG. 1 is an exploded perspective illustrating a seat assembly in accordance with an embodiment of the present invention, with the elements in a disassembled condition;

FIG. 2 is a perspective similar to FIG. 1 and illustrating the elements in their assembled condition;

FIG. 3 is an enlarged, fragmentary, sectional view illustrating the assembly of a plastic part to a metal frame member with a plastic securing element;

FIG. 4 is a fragmentary view of the subject matter of FIG. 3 enlarged still further; and FIG. 5 is a perspective of one embodiment of a plastic securing element in accordance with the present invention.

DETAILED DESCRIPTION

Referring initially to FIGS. 1 and 2, indicated generally at 10 is a seat for a mass transit vehicle. Seat 10 comprises a metal frame 11 on which is mounted an exterior, decorative, plastic seat shell 12 and exterior decorative, plastic side members 13, 14 utilizing plastic securing elements 15, 15 to assemble plastic shell 12 and plastic side members 13, 14 to metal frame 11.

Metal frame 11 comprises a tubular front portion 20 integral with rearwardly extending tubular side portions 21, 22 each integral with a respective vertically extending tubular side portion 23, 24 between the top ends of which extends a tubular top portion 25. Located between the bottom ends of vertical, tubular side portions 23, 24 is a rear frame member 26 having a plurality of planar portions. Attached to each of tubular side portions 21, 22 are respective planar side frame members 27, 28, and attached to tubular top portion 25 is a planar top frame member 29. Spring means 30 is located within and attached to the box defined by seat frame elements 20, 21, 22 and 26.

Plastic seat shell 12 comprises a back portion 33, a horizontally disposed top portion 34 extending forwardly from the top of back portion 33, a pair of vertically disposed side portions 35, 36 each extending forwardly from a respective opposite side of back portion 33 and a horizontally disposed bottom portion 38 extending forwardly from the bottom of back portion 33.

Referring to FIG. 5, each securing element 15 has a relatively wide head portion 40, and a relatively narrow shank portion 41 extending from head portion 40 and terminating at a terminal end 42.

Each of the frame members 26, 27, 28 and 29 are attached to respective tubular portions of metal frame 11 by welding, for example. Each of planar frame members 27, 28, 29 has a plurality of openings 43, 43 extending therethrough for receiving a shank portion 41 of a respective securing element 15. Similarly, the forwardmost planar portion 31 on rear frame member 26 has a plurality of openings 43 also for receiving a shank portion 41 of a securing element 15.

Decorative, plastic side members 13, 14 are mounted on planar side frame members 27, 28, respectively, while the top portion 34 and the bottom portion 38 of plastic shell 12 are respectively mounted on planar top frame member 29 and portion 31 of rear frame member 26, with all of said mountings utilizing securing elements 15, 15. Each of the plastic shell portions or decorative side members are mounted on their respective frame members or frame portions, with plastic securing elements 15, 15, in the same manner. For purposes of illustration, the details of the mounting of decorative plastic side member 13 on metal frame member 27 will now be discussed, but the discussion concerning these two members 13, 27 is equally applicable to the securement of the other exterior plastic parts to their respective metal frame members.

Referring to FIGS. 3 and 4, decorative plastic side member 13 has an inner surface 44 facing frame member 27. Frame member 27 has a first surface 45 located around opening 43 therein and facing inner surface 44 on plastic side member 13. Frame member 27 also has a second surface 46 opposite its first surface 45 and also located around opening 43.

In the illustrated embodiment, opening 43 is circular and head portion 40 and shank portion 41 of securing element 15 are cylindrical and concentric. Head portion 40 has a larger diameter than shank portion 41 and extends radially outwardly relative to shank portion 41. Shank portion 41 has a slightly smaller diameter than does opening 43 in frame member 27. Head portion 40 has a somewhat larger diameter than hole 43.

To secure plastic side member 13 to metal frame member 45, securing element 15 is inserted at opening 43 so that shank portion 41 extends through the opening and the inner surface of head portion 40 engages second surface 46 on metal frame member 27. As shown in FIG. 3, shank portion 41 has a length sufficient to project through opening 43 without extending substantially beyond the first surface 45 of frame member 27. Adhesive 48 is applied to terminal end 42 of securing element 15 (FIG. 4), and inner surface 44 of plastic side member 13 is abutted against adhesively coated terminal end 42 to adhesively secure the terminal end to inner surface 44. Adhesive may also be applied to inner surface 44 as well as terminal end 42.

As noted above, metal frame member 27 and plastic side member 13 have different respective coefficients of thermal expansion. However, the clearance 49 (FIG. 4) between (a) the outside of shank portion 41 and (b) the inside of opening 43 is sufficient to accommodate the differential in thermal expansion between metal frame member 27 and plastic side member 13.

Clearance 49 is substantially annular in shape. With respect to the mounting of side member 13 on frame member 27, clearance 49 surrounds the top and sides of shank portion 41, with the bottom of shank 41 normally resting on the bottom of opening 43.

In a typical embodiment, hole 43 has a diameter of about 1⅛ inch and shank portion 41 on securing element 15 has a diameter of about 1 1/16 inch, leaving a clearance 49 between the holes of about 1/16 inch. This is a sufficient clearance to accommodate the differential in thermal expansion between the plastic parts and the metal frame members.

The engagement of the peripheral portion 47 of head 40 against second surface 46 of frame member 13 prevents plastic side member 13, adhered to element 15, from being disconnected from its mounting on the metal frame.

Securing elements 15 constitute the totality of fastening means for securing the plastic shell 12 and the plastic side members 13, 14 to the metal frame 11.

Securing elements 15, 15, plastic shell 12 and plastic side members 13, 14 are all composed of the same material which may be the conventional plastic material heretofore utilized for the exterior plastic seat shells of mass transit vehicle seats. Examples include acrylic-modified polyvinyl chloride or a polyester reinforced with fiberglass.

Adhesive 48, for adhering securing elements 15, 15 to the plastic parts may be a conventional, commercially available, adhesive or adhesive system previously utilized for adhering together plastic materials of the type described in the preceding paragraph. Among such commercially available adhesives are structural adhesive resins identified by the registered trademark Versilok and described in Technical Bulletin DS10-3021F, 1977, Hughson Chemicals, Lord Corporation, Erie, Pennsylvania. Such adhesives are, of course, non-metallic. One such adhesive, identified as Versilok 506, a flexible, general purpose adhesive, has the properties described below.

Viscosity—25,000–125,000 cps
No. 3 at 10 RPM (HBF)
Weight—8.4 lbs./gal.
(1006 Kg/M$^3$)
Flash Point (closed cup)—53° F. (11.6° C.)
Lap Shear, psi—1400 (typical value for fiber glass reinforced polyester)

Versilok 506 may be applied to plastic surfaces coated with a material identified in said Technical Bulletin as Accelerator No. 4, supplied as a non-flammable lacquer and acting as a primer/activator on the substrates to be bonded. The accelerator is applied directly to the surfaces to be bonded. The solvent in the accelerator evaporates quickly, leaving a tack-free film. The adhesive resin is applied directly to the pre-coated surfaces with a thickness in the range 3–60 mils, and the cure time is approximately 13–17 minutes. Accelerator No. 4 has the properties described below.

Viscosity—60 cps
No. 2 at 30 RPM (LUT)
Weight—10.4 lbs./gal.
(1246 Kg/M$^3$)
Flash Point (closed cup)
None The foregoing detailed description has been given for clearness of understanding only and no unnecessary limitations should be understood therefrom as modifications will be obvious to those skilled in the art.

What is claimed is:

1. In a seat, the combination comprising:

a metal seat frame member;

an exterior plastic part having an inner surface facing said frame member;

a securing element having a relatively wide head portion and a relatively narrow shank portion extending from said head portion and terminating at a terminal end;

an opening extending through said frame member for receiving said shank portion;

a first surface on said frame member located around said opening, said first surface facing said inner surface on said exterior plastic part;

a second surface on said frame member, opposite said first surface and located around said opening;

means on said head portion of the securing element for engaging against said second surface on the frame member;

and non-metallic adhesive means for adhesively securing said terminal end of said shank portion to said inner surface of said exterior plastic part.

2. In a seat as recited in claim 1 wherein:

said metal frame member and said exterior plastic part have different respective coefficients of thermal expansion;

and said combination comprises means on said shank portion and on said frame member at said opening cooperating to define a clearance between the outside of said shank portion and the inside of said opening sufficient to accommodate the differential in thermal expansion between said metal frame member and said exterior plastic part.

3. In a seat as recited in claim 2 wherein:

said securing element is composed of the same plastic material as said exterior plastic part.

4. In a seat as recited in claim 1 wherein:

said opening is circular;

said head portion and said shank portion on the securing element are cylindrical and concentric;

and said head portion has a diameter larger than the diameter of said shank portion and of said opening.

5. In a seat as recited in claim 1 and comprising:

a plurality of said securing elements;

a plurality of said openings each for receiving a respective one of the shank portions on said plurality of securing elements;

and a plurality of adhesive means each for securing a terminal end on a respective one of said shank portions to said inner surface of said exterior plastic part.

6. In a seat as recited in claim 5 wherein:

said securing elements constitute the totality of means for securing said exterior plastic part to said metal frame member.

7. In a seat as recited in claim 1 wherein:

said metal frame member is part of a metal seat frame;

said exterior plastic part comprises an exterior plastic seat shell having an inner surface;

said seat comprises a plurality of said securing elements;

said metal seat frame has a plurality of openings each for receiving a respective one of the shank portions on said plurality of securing elements;

and a plurality of adhesive means each for securing a terminal end on a respective one of said shank portions to said inner surface of said shell;

said securing elements constituting the totality of means for securing said plastic seat shell to said metal seat frame.

8. In a seat as recited in claim 1 wherein:

said shank portion has a length sufficient to project through said opening without extending substantially beyond the first surface of said frame member.

* * * * *